US009836026B2

(12) United States Patent
Wan et al.

(10) Patent No.: US 9,836,026 B2
(45) Date of Patent: Dec. 5, 2017

(54) WALL CLOCK WITH CHANGEABLE SIZE

(71) Applicant: Lai Fun Wan, Hong Kong (HK)

(72) Inventors: Lai Fun Wan, Hong Kong (HK); Wai Tong Fung, Hong Kong (HK)

(73) Assignee: Lai Fun Wan, Tsuen Wan, N.T. (HK)

( * ) Notice: Subject to any disclaimer, the term of this patent is extended or adjusted under 35 U.S.C. 154(b) by 101 days.

(21) Appl. No.: 14/894,514

(22) PCT Filed: May 27, 2014

(86) PCT No.: PCT/CN2014/078471
§ 371 (c)(1),
(2) Date: Jan. 20, 2016

(87) PCT Pub. No.: WO2014/190889
PCT Pub. Date: Dec. 4, 2014

(65) Prior Publication Data

US 2016/0357153 A1 Dec. 8, 2016

(30) Foreign Application Priority Data

May 28, 2013 (CN) ..... 2013 1 0203868

(51) Int. Cl.
*G04B 37/00* (2006.01)
*G04G 17/04* (2006.01)
*G04B 33/00* (2006.01)

(52) U.S. Cl.
CPC ..... *G04B 37/0066* (2013.01); *G04B 33/00* (2013.01); *G04G 17/04* (2013.01)

(58) Field of Classification Search
CPC .. G04B 37/0066; G04B 47/02; G04B 47/046; A47G 1/065
See application file for complete search history.

(56) References Cited

U.S. PATENT DOCUMENTS 347,337 A * 8/1886 Ethridge ..... G04B 19/16 368/231
401,697 A * 4/1889 Ethridge ..... G04B 19/16 368/231

(Continued)

*Primary Examiner* — Vit W Miska
*Assistant Examiner* — Jason Collins
(74) *Attorney, Agent, or Firm* — Nyemaster Good P.C.

(57) ABSTRACT

The present invention discloses a wall clock with changeable size comprising a clock base, a front cover, a dial, a framework assembly, a rear cover and a framework assembly disposed between the dial and the rear cover, in which the framework assembly comprises a central dish for displaying time, which is configured to be suitable for passing through one of the holes of the dial; a plurality of arms, each of which is configured to be retractable in a length direction thereof, and has one end being secured to the central dish; and a plurality of fixing members for the arms, mounted removably and radially at different positions of the other end of the respective arms so that the framework assembly can be fixed in the clock base. By changing the length of the arms and the style of the dishes, variety in the function display and size of the assembled wall clock can be obtained, which not only increases the decorative function of the wall clock, but also decreases the mold and manufacturing cost, shortens the manufacturing and product development time.

11 Claims, 5 Drawing Sheets

(56) References Cited

U.S. PATENT DOCUMENTS

| | | | | | |
|---|---|---|---|---|---|
| 657,167 | A * | 9/1900 | King | G04G 21/08 | 368/69 |
| 3,071,284 | A * | 1/1963 | Mallow | G04B 37/0066 | 220/315 |
| 4,601,585 | A * | 7/1986 | Farley | G04B 19/042 | 368/238 |
| 5,172,350 | A * | 12/1992 | Walen | G04B 45/00 | 368/228 |
| 6,421,302 | B1 * | 7/2002 | Wimberly | G04B 19/23 | 368/223 |
| 6,553,698 | B1 * | 4/2003 | Kemeny | G09F 15/0068 | 160/135 |
| 6,942,379 | B2 * | 9/2005 | Hardy | G04B 37/1413 | 368/276 |
| 7,480,213 | B2 * | 1/2009 | Muraji | G04B 19/16 | 368/223 |
| 8,480,247 | B2 * | 7/2013 | Fleet | G04B 47/02 | 362/253 |
| 2006/0067169 | A1 * | 3/2006 | Mo | G04B 19/10 | 368/223 |

* cited by examiner

WALL CLOCK WITH CHANGEABLE SIZE

TECHNICAL FIELD OF THE INVENTION

The present invention generally relates to a timepiece, and more particularly to wall clocks with changeable appearance and size, so as to distinctively improve the utility and decoration of wall clocks.

BACKGROUND OF THE INVENTION

Wall clocks are well known devices in the timekeeping art and very important articles for daily use. In view of the beautiful design and appearance of the wall clocks, they function not only as timekeeping device, but as decorative objects as well today. With the increasingly living standard, the appearance, size and other aspects are highly required gradually, and consumers may select a wall clock with different size, shape or appearance according to the different surroundings. This may raise a question that when consumers select a wall clock with different size, shape or appearance, they would buy different kind of wall clocks. For example, when wall clocks sized 12 inch or 18 inch are selected, two wall clocks sized 12 inch and 18 inch are needed to, respectively purchase, which may result in not only great burden for consumer, but also increase of manufacturing time and cost for manufacturer.

Wall clocks which dial features can be changed are disclosed in prior art, but the wall clocks which can be changed in size are not disclosed in prior art. For example, U.S. Pat. No. 5,787,055 discloses a changeable wall clock, which designs to use 4 dials with different design and style to realize the changeable function. Users can open the cover and change the dials in clock base to obtain 4 different kinds of style. However, it still has a disadvantage of failure to change in size.

Therefore, there is a need to improve the wall clocks in existing technology so that if desired, consumers can assemble wall clocks with different size, and at the same time, the producing cost of a wall clock should be decreased.

SUMMARY OF THE INVENTION

This invention responds to the above needs of changing size of the wall clock. According to one aspect of the invention, the object of the invention is to provide a wall clock which size can be changed. This wall clock is designed to change length of the interior element to change the size of wall clock in its entirety.

According to another aspect of the invention, the object of the invention is to provide a wall clock with a variety of different dishes mounted therein so as to display different functions on the basis of different requirements.

To achieve the above objects, the following technical solutions are adopted:

A wall clock with changeable size comprising:

a clock base;

a transparent front cover secured in the clock base;

a dial disposed in the clock base adjacent to the front cover, which has a plurality of holes thereon;

a rear cover secured in the clock base; wherein the wall clock further comprises a framework assembly disposed in the clock base adjacent to the dial in which the framework assembly comprises a central dish for displaying time, which is configured to be suitable for passing through one of the holes of the dial;

a plurality of arms, each of which is configured to be retractable in a length direction thereof, and has one end being secured to the central dish;

a plurality of fixing members for the arms, mounted removably and radially at different positions of the other end of the respective arms so that the framework assembly can be fixed in the clock base.

According to the wall clock with changeable size of the invention, the wall clock further comprises a hollow hiding member disposed between the front cover and dial in the clock base.

According to the wall clock with changeable size of the invention, the wall clock further comprises a plurality of dishes mounted on the arms, which are suitable for the holes of the dials. According to the present invention, the number of the dish is ranged 2-10, and preferably 4-7.

According to the wall clock with changeable size of the invention, the dish is selected from the group consisting of analogue display dish, digital display dish or combination thereof.

According to the wall clock with changeable size of the invention, the wall clock further comprises a battery compartment with a battery door, which is mounted on the arm.

According to the wall clock with changeable size of the invention, the wall clock further comprises power supply disposed in the battery compartment, in which the power supply is selected from the group consisting of solar battery, lithium-ion battery, AC power source or DC power supply.

According to the wall clock with changeable size of the invention, a plurality of pores are set on the arms, and the fixing members for the arms are fixed on the arms by screws through the pores.

According to the wall clock with changeable size of the invention, the fixing members for arms are locks.

According to the wall clock with changeable size of the invention, the number of arms is ranged 2-10. Preferably, the number of arms is ranged 4-7.

According to the wall clock with changeable size of the invention, two-dimensional or three-dimensional text, numeric, character, pattern or solar power is printed on the dial.

According to the wall clock with changeable size of the invention, two-dimensional or three-dimensional text, numeric, character, pattern or solar power is printed on the dish.

Accordingly, the wall clock of the invention is structurally different from the wall clock in prior art. In addition, by virtue of the extension or retraction of the framework assembly in the wall clock and the combination of the dishes of the wall clock, the wall clock of the invention can provide a convenient, effective and economical means by which owners or users of the wall clock can periodically and simply change the size and function display of the clock to suit changing seasons, tastes or moods without additional cost, if desired.

BRIEF DESCRIPTION OF THE DRAWINGS

The features of the present invention may be clearly set forth with reference to the accompanying drawings. The invention, together with the advantages thereof may be best understood by reference to the following description taken in conjunction with the accompany drawings, wherein like reference signs identify like elements, and wherein.

DETAILED DESCRIPTION OF THE INVENTION

The structure of the device of the invention will be explained in detail with reference to the accompany drawings. The description and explanatory embodiment herein are merely used to set forth the present invention, not to limit the invention.

Figure 1:
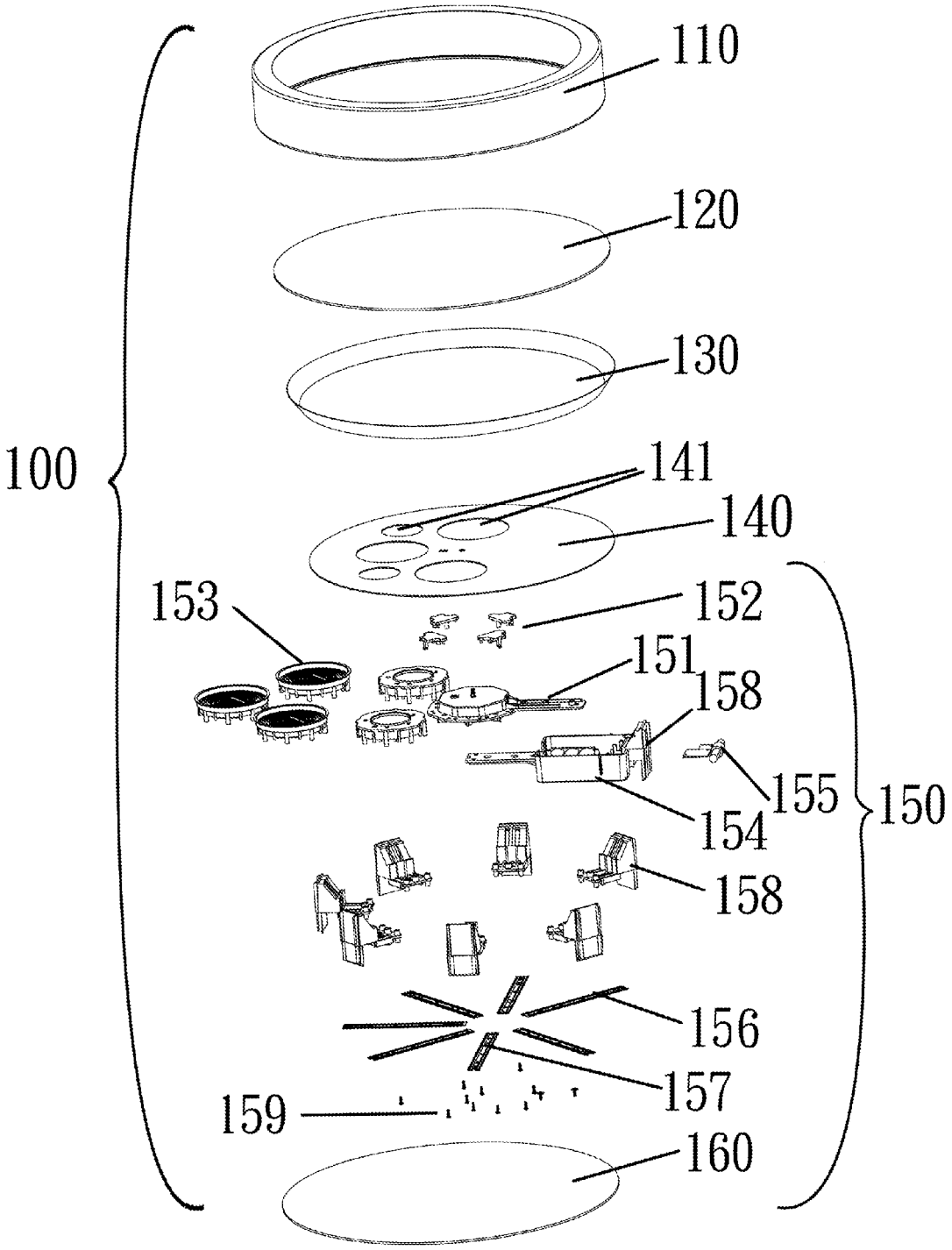
FIG. 1 is an exploded perspective view of a wall clock with changeable size of the invention.

As illustrated in FIG. 1, a wall clock with changeable size 100 comprises a clock base 110, a front cover 120, a dial 140, a framework assembly 150 and a rear cover 160.

The clock base 110 may be used for receiving other elements/components of the wall clock 100 and may be shaped differently, for example it can be shaped to be a circle or a rectangle, or others which are familiar with the skilled person in the art. Furthermore, the clock base 110 can be made of different materials such as plastics, mental, ceramics, bamboo, wood, etc.

The front cover 120 is disposed in the clock base 110 and is shaped to be correspondent to the clock base 110. The front cover 120 is made of transparent material like glass or transparent plastic. As is known in the art, the front cover 120 is assembled in the clock base 110 by means which is familiar with the skilled person in the art.

The dial 140 is disposed in the clock base 110, which is adjacent to the front cover 120. The dial 140 which has a plurality of holes formed thereon is shaped to be correspondent to the clock base 110. Different decorations such as 2-D/3-D text, numeric, character, pattern or solar power, such as solar membrane, can be formed on the dial 140, which can be clearly observed by consumers through the transparent front cover 120. These decorations may be made by means of printing, pasting, spraying, hot stamping or water floating.

Figure 2:
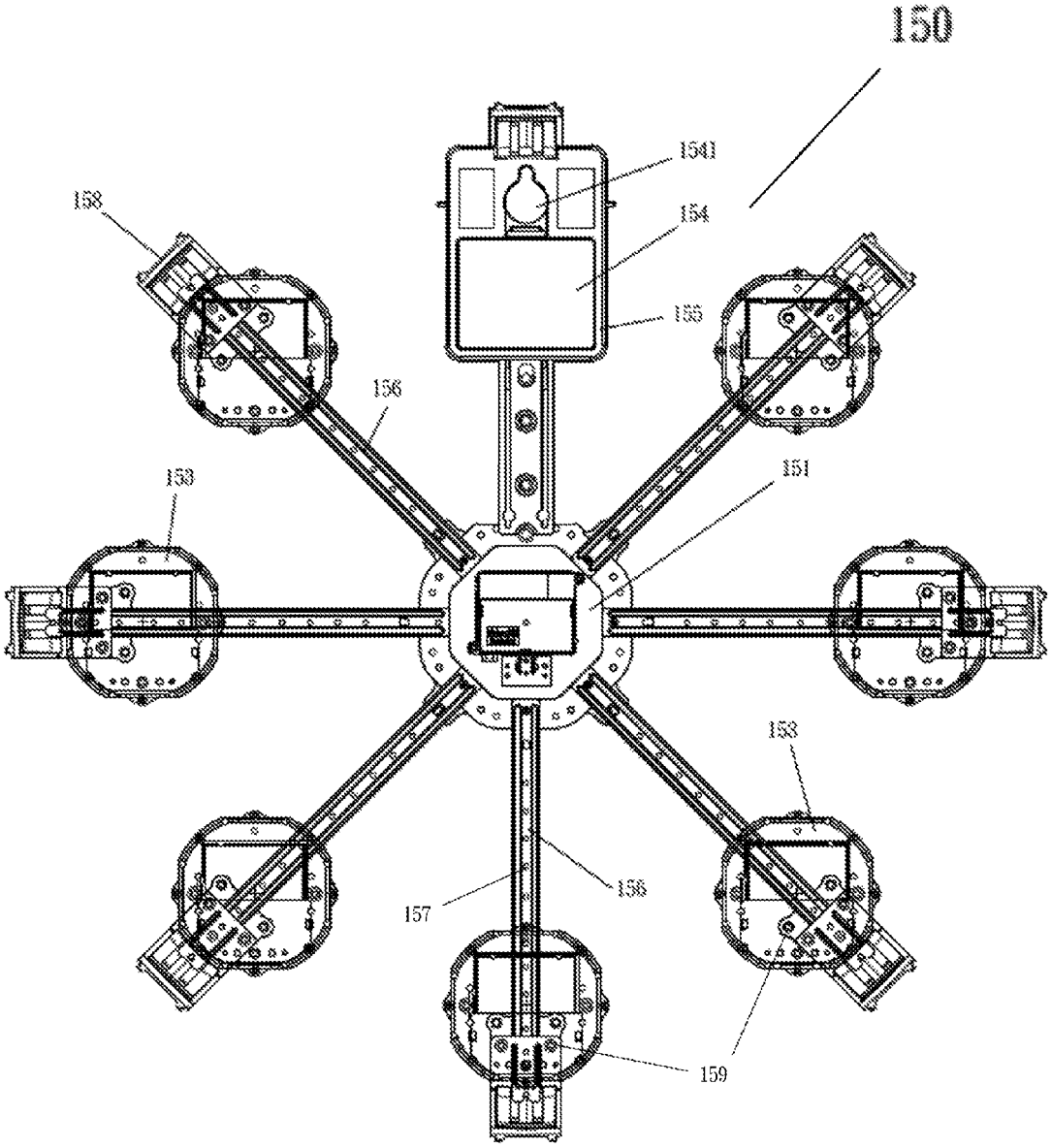
FIG. 2 is a schematic view of a framework assembly of a wall clock with changeable size of the invention.

The framework assembly 150 is of most importance, which is disposed in the clock base 110 and is adjacent to dial 140. Referring to FIG. 2, the framework assembly 150 is retractable, which comprises: a central dish 151 configured to be suitable for one of the holes 141 in dial 140; a plurality of arms 156 made usually of metal, in which one end of each is secured to the central dish 151, and a fixing member 158 is mounted on the other end so that when using the fixing member 158, the framework assembly 150 in its entirety can be disposed in the clock base 110; a plurality of dishes 153 for displaying different function mounted on the arms 156, which are configured to be suitable for the corresponding holes 141 on dial 140 and can be shaped differently as circle or rectangle or others; and a battery compartment 154 with a battery door 155. In one embodiment of the invention, the dish 153 is secured to the arms 156 by first fixing members 152. Preferably, the first fixing member 152 is a lock member.

In one embodiment of the invention, the fixing member 158 for arms 156 may be a lock member with a plurality of pores 157 formed thereon, so that the lock member can screwed through the pore 157 to fix the lock member on the arms 156.

Specifically, the framework assembly 150 is retractable resulting from the retractable arms 156. When the framework assembly 150 need to be extended, in order to mount the framework assembly 150 in a larger clock base 110, the arms 156 can be extended by adjusting the fixing member 158 for arm 156 to an appropriate position, followed by fixing the fixing member 158 by means of screw 159. In case there is a need to further change the length of the arms 156, the screw 159 is merely loosened, followed by adjusting the length of the arms and the fixing member 158, and further fixing them together.

Figure 3:
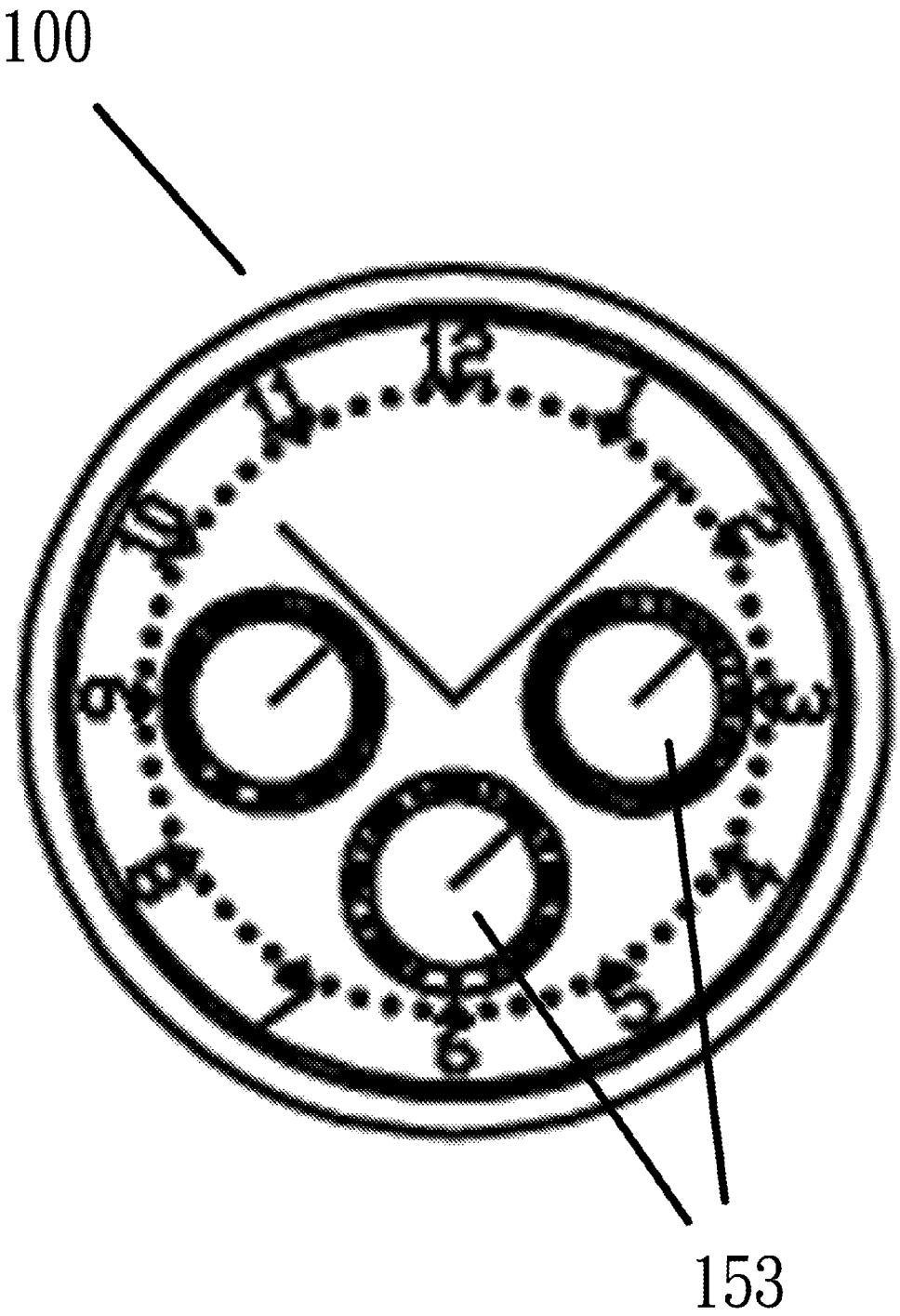
FIG. 3 is a schematic view of a wall clock having one type of combination of dishes, after a wall clock with changeable size of the invention is fully assembled.
Figure 4:
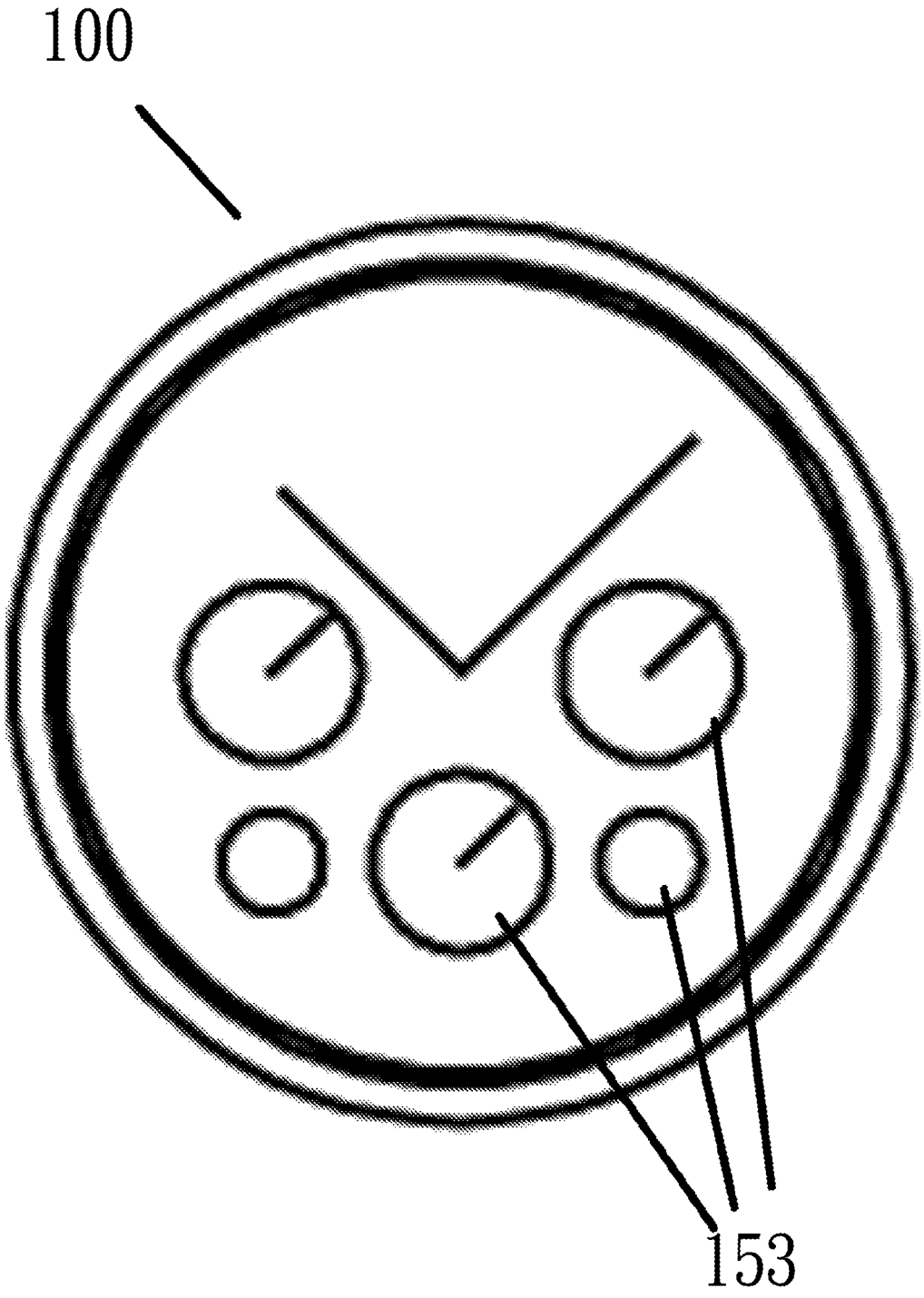
FIG. 4 is a schematic view of a wall clock having another type of combination of dishes, after a wall clock with changeable size of the invention is fully assembled.
Figure 5:
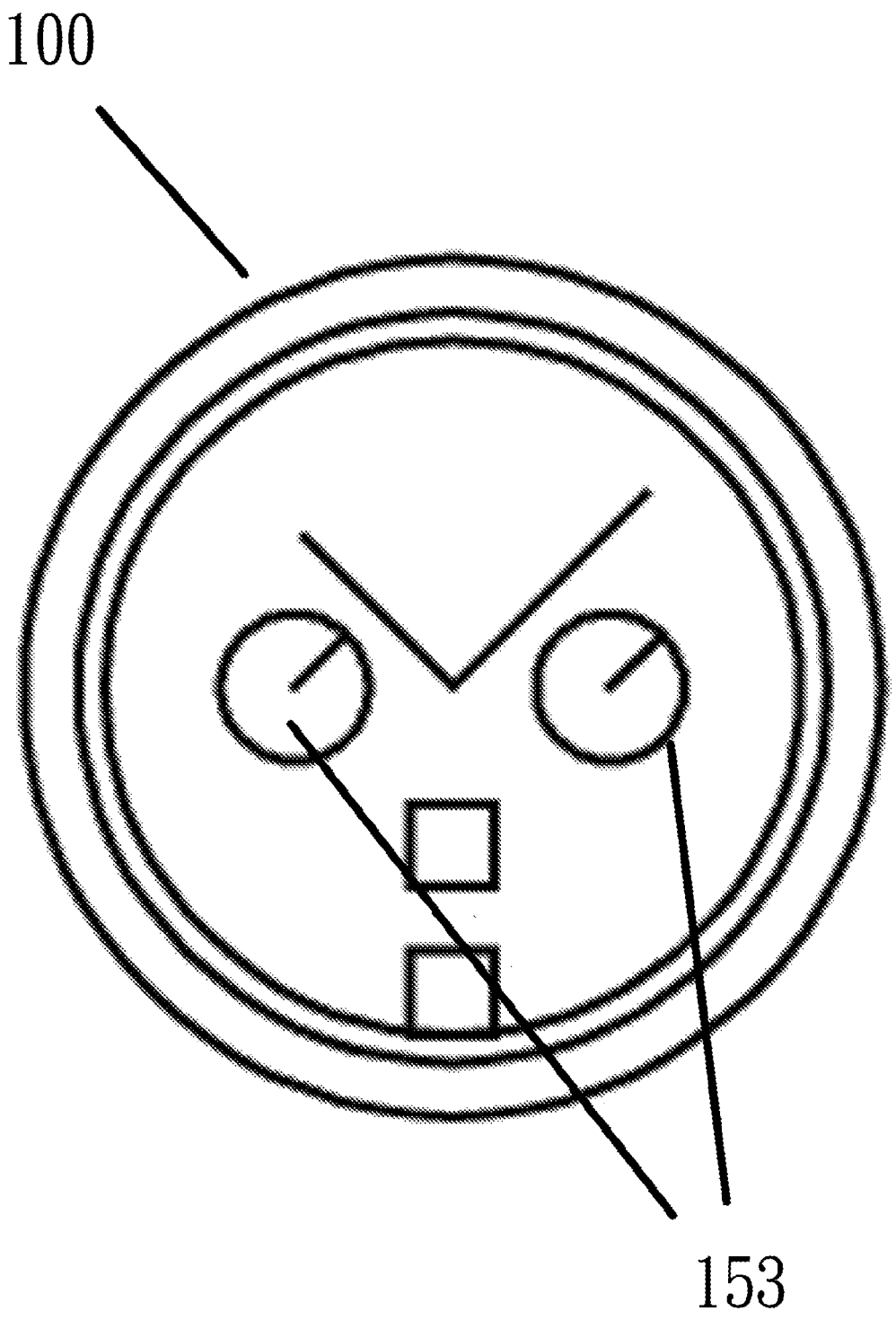
FIG. 5 is a schematic view of a wall clock having another type of combination of dishes, after a wall clock with changeable size of the invention is fully assembled.

As illustrated in FIG. 3-5, the dishes 153 having different shape\size and function display are shown in the wall clocks 100. The number of the dish 153 depends on the number of arm 156. Preferably, one framework assembly 150 can have 4-7 arms 156. The dish 153 can be analogue display dish or digital (LCD/LED) display dish or a combination thereof. The dish 153 is used for displaying the following contents: year, month, date, day of week, time of alarms, timer, time zones, moon phase, temperature, pressure, UV, humidity and/or weather forecast by multi-hand or multi digital display. Furthermore, different decorations such as 2-D/3-D text, numeric, character, pattern or solar power, such as solar membrane, can also be printed on the dishes 153. For example, year, month, day, UV, character, pattern can all be printed on one dish 153. Hence, dishes 153 with different displaying contents can be assembled on the arms 156, rendering different styles of the wall clocks, so that the decoration and function of the wall clock 100 can be diversified. For instance, for one size of a wall clock such as sized 14 inch, it can be configured up to 128 combinations of dishes 153 on the dial 140.

In one embodiment of the invention, power supply may be disposed in the battery compartment 154, in which the power supply can be solar battery, lithium-ion battery, AC power source, DC power supply or a combination thereof.

In one embodiment of the invention, the battery compartment 154 is preferably located at the position which the hour hand is directed to 12 o'clock.

In one embodiment of the invention, a raised boss 1541 is preferably located at the battery compartment 154, which is used to hang the wall clock 100 on the wall.

In one embodiment of the wall clock 100 of the invention, a hiding member 130 having a hollow structure is disposed between the front cover 120 and the dial 140 in the clock base 110. The hiding member 130 is used for hiding the fixing member 158 in the clock base 110. In other words, after fully assembled the wall clock 100, the inner elements except for the dial 140 and dishes 153 cannot be observed, thereby rendering the wall clock 100 more simple and more beautiful. In another embodiment of the invention, the hiding member 130 is a paper banner in which the texts and marks can be easily printed on the banner surface before it is bent. But the hiding member 130 can be made of other material such as metal or plastic.

The rear cover 160 is mounted in the clock base 110, and is adjacent to the framework assembly 150. The rear cover 160 is shaped to correspond to the clock base 110. As is known in the art, the rear cover 160 is used for protection of the wall clock 100.

By utilizing the technical solution of this invention, a wall clock with changeable size and different function display can be easily assembled. For example, as is known, wall clocks having a size of 12 inch, 14 inch, 16 inch or 18 inch, etc., are commercially available, consumer can only buy a set of elements with less cost to obtain a plurality of wall clocks with different sizes, such as 12 inch, 14 inch, 16 inch or 18 inch wall clocks. For the manufacturer, the producing cost is sharply down, because the framework assembly 150, which is the main and expensive component of a wall clock, is molded once. Thus, the wall clock 100 herein shown and described provides great variety in the possible change of size of the assembled wall clock 100. Furthermore, the wall clock 100 may provide great flexibility in the possible function displays of the assembled wall clock 100 while retaining the efficiencies and economies that result from mass manufacture of the unchanging the main component, i.e., the framework assembly 150.

As described above, because the framework assembly 150 is retractable, the manufacturer only need to manufacture different sizes of the clock base 110, the front cover 120, the hiding member 130, the dial 140 and the rear cover 160, and consumer can buy a set of the above elements and change the size of wall clock to obtain a number of different wall clocks by using one framework assembly 150, without great costs for purchasing a number of wall clocks with different size in the market.

While a particular embodiment of the invention has been shown and described, it will be obvious to those skilled in the art that changes and modifications can be made without departing from the true spirit and scope of the invention. It should be understood that the embodiments of the present invention described above are illustrative only, and all the changes and modifications made by those skilled in the art are covered by the appended claims.

The invention claimed is:

1. A wall clock with changeable size comprising:

a clock base;

a transparent front cover disposed in the clock base;

a dial disposed adjacent to the front cover in the clock base, which has a plurality of holes thereon;

a rear cover disposed in the clock base; wherein the wall clock further comprises a framework assembly disposed adjacent to the dial in the clock base comprising:

a central dish for displaying time, which is configured to be suitable for passing through one of the holes of the dial;

a plurality of arms, each of which is configured to be retractable in a length direction thereof, and has one end being secured to the central dish;

a plurality of fixing members for the arms, mounted removably and radially at different positions of the other end of the respective arms so that the framework assembly can be fixed in the clock base.

2. The wall clock with changeable size according to claim 1, wherein the wall clock further comprises a hollow hiding member disposed between the front cover and the dial in the clock base.

3. The wall clock with changeable size according to claim 1, wherein the wall clock further comprises a plurality of dishes mounted on the arms, which are suitable for passing through the holes of the dials.

4. The wall clock with changeable size according to claim 3, wherein the dish is selected from the group consisting of analogue display dish, digital display dish or a combination thereof.

5. The wall clock with changeable size according to claim 3, wherein two-dimensional or three-dimensional text, numeric, character, pattern or solar power is printed on the dishes.

6. The wall clock with changeable size according to claim 1, wherein the wall clock further comprises a battery compartment with a battery door, which is mounted on the arm.

7. The wall clock with changeable size according to claim 6, wherein the wall clock further comprises a power supply disposed in the battery compartment, in which the power supply is selected from the group consisting of solar battery, lithium-ion battery, AC power source or DC power supply.

8. The wall clock with changeable size according to claim 1, wherein a plurality of pores are set on each of the arms, and the fixing members for the arms are fixed on the arms by screws through the pores.

9. The wall clock with changeable size according to claim 8, wherein the fixing members are lock members.

10. The wall clock with changeable size according to claim 1, wherein the number of arms is 4-7.

11. The wall clock with changeable size according to claim 1, wherein two-dimensional or three-dimensional text, numeric, character, pattern or solar power is printed on the dial.

* * * * *